US008099985B2

(12) United States Patent
Burmesch et al.

(10) Patent No.: US 8,099,985 B2
(45) Date of Patent: Jan. 24, 2012

(54) LATCHING ARRANGEMENTS FOR A PADLOCK

(75) Inventors: Gary Burmesch, Port Washington, WI (US); Jesse Marcelle, Muskego, WI (US); Glenn P. Meekma, Menomonee Falls, WI (US); Dean A. Paulson, Oak Creek, WI (US)

(73) Assignee: Master Lock Company LLC, Oak Creek, WI (US)

( * ) Notice: Subject to any disclaimer, the term of this patent is extended or adjusted under 35 U.S.C. 154(b) by 443 days.

(21) Appl. No.: 12/397,732

(22) Filed: Mar. 4, 2009

(65) Prior Publication Data

US 2009/0223258 A1 Sep. 10, 2009

Related U.S. Application Data

(60) Provisional application No. 61/033,469, filed on Mar. 4, 2008.

(51) Int. Cl.
*E05B 37/06* (2006.01)

(52) U.S. Cl. ..... 70/25; 70/38 B

(58) Field of Classification Search ..... 70/21, 22, 70/24, 25, 38 A, 38 B, 38 C, 38 R, 51
See application file for complete search history.

(56) References Cited

U.S. PATENT DOCUMENTS

| | | | |
|---|---|---|---|
| 2,893,231 | A | 7/1959 | Soref et al. |
| 3,563,067 | A | 2/1971 | Foote |
| 3,990,275 | A | 11/1976 | Lippisch |
| 4,055,972 | A | 11/1977 | Calegan |
| 4,422,311 | A | 12/1983 | Zabel et al. |

OTHER PUBLICATIONS

International Search Report and Written Opinion from International Application No. PCT/US09/35987, mailed May 8, 2009.

*Primary Examiner* — Suzanne Barrett
(74) *Attorney, Agent, or Firm* — Calfee, Halter & Griswold LLP

(57) ABSTRACT

A padlock includes a lock body, shackle, locking mechanism and latch member. The latch member includes a laterally outermost shackle engaging portion that lockingly engages a recess in the shackle when the locking mechanism is in a locked condition and is disengageable from the recess when the locking mechanism is in an unlocked condition. The latch member is sized such that upward facing surfaces of the latch member that align with a circumferential edge of a shackle opening are limited to a notch laterally aligned with a laterally innermost portion of the circumferential edge when the shackle engaging portion is in a normal locking engagement with the recess.

20 Claims, 6 Drawing Sheets

LATCHING ARRANGEMENTS FOR A PADLOCK

CROSS-REFERENCE TO RELATED APPLICATION

This application claims the benefit of U.S. Provisional Patent Application Ser. No. 61/033,469, entitled "LATCHING ARRANGEMENTS FOR A PADLOCK" and filed Mar. 4, 2008, the entire contents of which are incorporated herein by reference, to the extent that they are not conflicting with the present application.

BACKGROUND

Padlocks are used in a variety of applications, including, for example, with enclosures such as lockers, storage sheds, and various gates and doors, to secure two or more hasps, latches or other structures together to restrict access to an item or enclosure. A conventional padlock includes a shackle having two ends secured within a lock body by one or more locking members when in a locked condition, with the locking members being disengageable from the shackle in the unlocked condition to allow movement of the shackle to separate one end (or leg) of the shackle from the lock body. Some padlocks include key operated arrangements in which insertion of a proper key in a keyway permits rotation of a key cylinder to release or disengage one or more locking members from the shackle. Other padlocks include a combination (or permutation) dial operable to rotate a series of cams to an unlocking orientation, in which the cams permit disengagement of one or more locking members from the shackle.

One conventional padlock includes a sliding latch that is secured in engagement with a corresponding notch in the shackle when the padlock is locked. When the padlock is unlocked, the latch is slidable out of engagement with the shackle recess to permit withdrawal of a short leg of the shackle from the lock body. One example of such a padlock is shown in FIGS. 1A through 1C, and is described in U.S. Pat. No. 3,990,275 (the "'275 patent"), the entire disclosure of which is incorporated herein by reference, to the extent that it is not conflicting with the present application. As shown in FIGS. 1A-1C, the combination padlock of the '275 patent includes a pivotable lever or rocker 23 that receives a slidable latch or latch bolt 24 for locking engagement with a corresponding notch 25 in the shackle 27. When the rocker 23 is in a first orientation (corresponding with the locked condition), as shown in FIG. 1A, the latch 24 is prevented from retracting into the rocker 23 and out of engagement with the shackle recess 25, by full engagement of the latch nose 48 with the notch 25, and interference between the latch shoulder 51 and the front edge of the recess 35 in the rocker 23. When the combination dial is rotated to the proper series of positions, slots 40 in a series of tumbler disks align with an extension or tongue 39 of the rocker 23, thereby permitting the rocker 23 to pivot to a second orientation (corresponding with the unlocked condition). In this second orientation, the latch 24 becomes disengaged from the shackle recess 25, such that the short leg 26 of the shackle 27 may be withdrawn from the lock body or lock casing 10 to unlock the padlock. To re-lock the padlock, reinsertion of the short leg 26 of the shackle 27 into the lock body causes the short leg 26 to cam against the latch nose 48, retracting the latch 24 into the rocker 23 to permit full insertion of the shackle 27. When the shackle recess 25 is realigned with the latch nose 48, spring 37 forces the latch 24 back into locking engagement with the shackle recess 25.

Other examples of padlocks with similar locking arrangements are described in U.S. Pat. Nos. 2,893,231 and 4,422,311, the entire disclosures of both of which are incorporated herein by reference, to the extent that they are not conflicting with the present application.

Whether combination dial operated, key operated, or both, padlocks having a slidable latch for engaging and disengaging the shackle may be vulnerable to unauthorized opening of the lock (and access to the locked item, structure, or enclosure with which the lock is used) by tampering with the latch. For example, a slidable latch may be manipulated using a shim, pick, or other such tool or device inserted between the shackle and the edge of the shackle hole in the lock body. Additionally or alternatively, the shackle of this type of padlock may be rapped or otherwise impacted to move the latch with respect to the shackle, in an effort to disengage the latch from the shackle.

SUMMARY

The present application describes several inventive features and arrangements for preventing or inhibiting unauthorized opening of a padlock by shimming, picking, or rapping a padlock shackle.

According to an inventive aspect of the present application, a shackle engaging latch within a padlock may be configured to inhibit manipulation by a shim, pick, or other tool inserted between the edge of the shackle hole and the locked shackle leg. As one example, a latch may be sized such that upward facing surfaces of the latch that align with a circumferential edge of a shackle opening are limited to a notch configured to prevent an inserted tool from imparting a lateral force against the latch.

Accordingly, in one exemplary embodiment, a padlock includes a lock body, shackle, locking mechanism and latch member. The latch member includes a laterally outermost shackle engaging portion that lockingly engages a recess in the shackle when the locking mechanism is in a locked condition and is disengaged from the recess when the locking mechanism is in an unlocked condition. The latch member is sized such that upward facing surfaces of the latch member that align with a circumferential edge of a shackle opening are limited to a notch laterally aligned with a laterally innermost portion of the circumferential edge when the shackle engaging portion is in a normal locking engagement with the recess.

The present application further describes additional inventive features for preventing or inhibiting unauthorized opening of a padlock. As one example, a second notch may be provided in an upper surface of a shackle engaging portion of a latch member, to align with a laterally innermost portion of a circumferential edge of a shackle opening when the latch member is rapped to a second position of locking engagement laterally inward of normal locking engagement with a shackle recess. As another example, a latch member may be provided with a release lever engaging portion that is laterally spaced from a circumferential edge of a shackle opening when the latch member is in a shackle engaging position, for example, to inhibit access to the release lever engaging portion by an inserted tool. As still another example, a latch member that is retractable into a channel in a pivotable rocker may be configured to pivot about an upper post within the channel such that an upward extending shoulder of a shackle engaging portion of the latch member overlaps an upper edge of the channel to impede retraction of the latch member into the channel.

BRIEF DESCRIPTION OF THE DRAWINGS

Features and advantages of the invention will become apparent from the following detailed description made with reference to the drawings, wherein.

DETAILED DESCRIPTION

The present application describes several inventive features associated with a padlock having a movable latch that lockingly engages a shackle to secure the shackle in a locked position. According to an inventive aspect of the present application, a padlock may be configured to inhibit manipulation of the latch by a shim or other such tool inserted between the shackle and the shackle hole. In a conventional sliding latch padlock, a shim inserted between the shackle and the shackle hole may be pressed against the laterally outward facing front "nose" or shackle engaging portion of the latch, in turn forcing the latch into a channel in a pivotable rocker and out of engagement with the shackle recess. Accordingly, in one embodiment, a sliding latch may be provided with one or more notches or other such recesses on this front nose portion. As a result, a shim inserted between the shackle and the shackle hole to retract the latch will instead engage the notch, thereby preventing further insertion of the shim or the application of inward (or retracting) force against an outward facing surface of the latch.

FIGS. 2-5 illustrate partial views of an exemplary combination padlock having a latch assembly including a pivotable rocker 110 and a sliding latch 120 configured to prevent or inhibit unauthorized opening of the lock through manipulation of the latch. Aspects of the padlock not described herein may, but need not, be consistent with those aspects described in the above incorporated patents.

Figure 2:
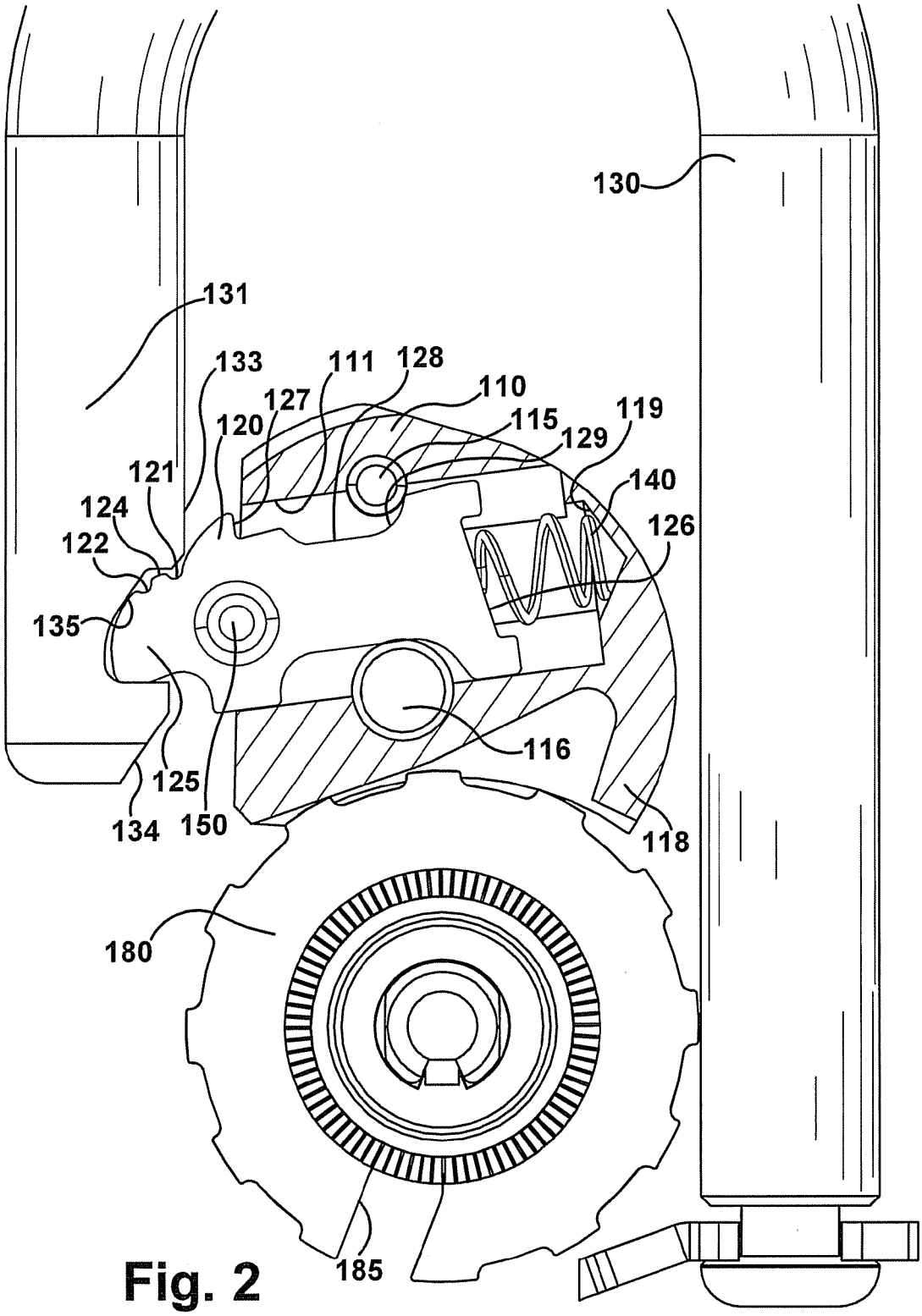
FIG. 2 illustrates a partial perspective view of a combination lock, with the rocker shown in phantom to illustrate additional portions of the lock.

As shown, the latch 120 includes multiple notches 121, 122 in an outward facing surface 124 of a shackle engaging nose portion 125 of the latch 120. In the latch's normal locking condition, as shown in FIG. 2, when the latch has not been rapped or impacted out of position, a first notch 121 aligns with an innermost surface 133 of the short leg 131 of the shackle 130, to receive a shim or other tool inserted between the shackle inner surface 133 and the shackle hole (not shown), thereby preventing further insertion of the tool and/or retracting forces against the latch 120. While the notch may assume many different shapes or contours and may be any suitable surface indentation or non-smooth undulation, in the illustrated embodiment, the notch 121 includes opposed upwardly extending sides, which inhibit the inserted shim from being bent or flexed outward of the notch, for example, to impact another surface of the latch 120.

In some lock tampering efforts, a padlock shackle may be rapped, jarred, or impacted in an effort to facilitate manipulation of the sliding latch. This impact may take advantage of a loose fit or "play" between the shackle and the lock body to partially withdraw the latch from normal locking engagement within the shackle recess, while remaining in locking engagement with the shackle recess. A second notch 122 in the latch 120 may be positioned to align with the short leg inner surface 133 when the latch 120 is partially retracted or withdrawn from the shackle recess 135 (for example, as a result of pulling on the shackle 130), to further inhibit tool manipulation (such as shimming) of the latch 120 in such a condition. In other embodiments, additional, differently shaped, and/or alternatively positioned notches may be provided in the latch to thwart tool manipulation of the latch.

Figure 3:
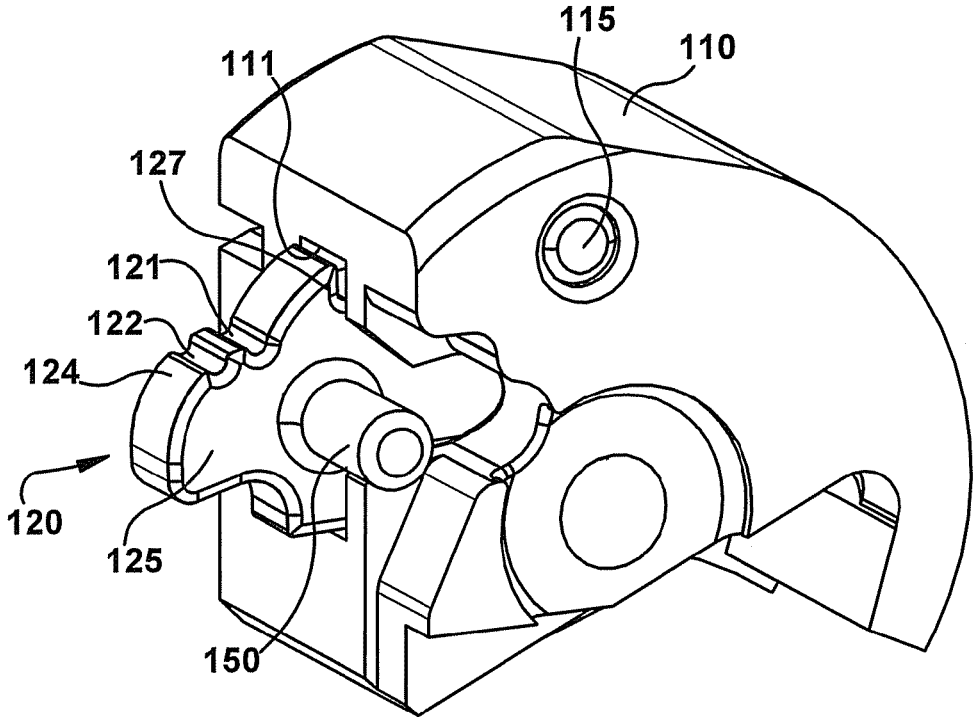
FIG. 3 illustrates a perspective view of the rocker and latch of the lock of FIG. 2.
Figure 4:
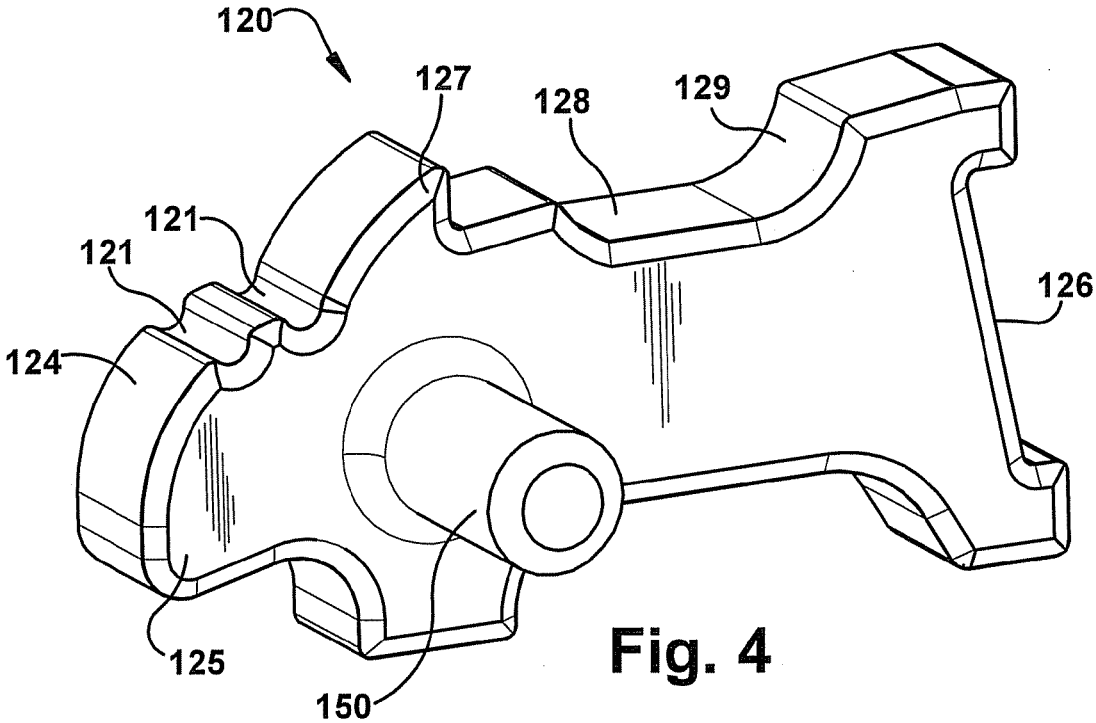
FIG. 4 illustrates a perspective view of the latch of FIG. 2.

Unauthorized tool manipulation of a slidable latch may also be attempted by sliding an inserted tool or shim around the outer surface of the secured shackle until the tool engages a portion of the latch extending laterally outward from the shackle, in an attempt to retract the latch into the rocker. According to another inventive aspect of the present application, as shown in FIGS. 3 and 4, the entire shackle engaging portion 125 of the latch 120 may be sized to be thinner than the shackle and may, for example, form a flat, plate-like extension from the rocker 110. When combined with the inclusion of notches 121, 122 in the nose portion 125, inserted tool access to the slidable latch 120 may be substantially limited to the notched upper portion of the shackle engaging latch nose 125.

According to another inventive aspect of the present application, a pivotable rocker and slidable latch of a padlock may be configured to maintain the latch in a secured or "deadlocked" extended position when the padlock is locked to further prevent unauthorized retraction of the latch into the rocker, for example, by rapping the shackle. In one embodiment, a slidable latch is forced or biased into a position in which a shoulder of the latch interferes with an edge of the recess in the rocker, thereby preventing further retraction of the latch into the rocker. Many different arrangements may be utilized to force the latch into this deadlocked condition when the padlock is locked. As one example, as shown in FIGS. 2 and 3, an upper post 115 (e.g., a pin or lug) may be installed in the rocker 110 to retain the latch 120 in a channel 111 within the rocker 110. The upper post 115 is received in a notch or cutout 128 in the upper surface of the latch 120. The cutout 128 includes a lug bearing surface 129 (see FIG. 4). The latch spring 140 (see FIG. 2) biases the latch 120 outward, causing the latch 120 to pivot about the upper post 115 on the lug bearing surface 129, thereby moving the latch shoulder 127 out of alignment with the rocker channel 111 (i.e., overlapping an upper edge of the channel 111) to prevent retraction of the latch 120 into the channel 111. A rear spring-bearing surface 126 of the latch 120 may be angled with respect to a spring bearing surface 119 of the rocker 110 to increase the pivoting force.

In the illustrated embodiment, when the combination dial is rotated to align slots 185 of tumbler discs 180 (see FIGS. 2 and 5) with an extension 118 of the rocker 110, a pulling force applied to the shackle 130 pivots the rocker 110 about a central hub or lower post 116, thereby pivoting the latch 120 out of engagement with the shackle recess 135. When the short leg 131 of the shackle 130 is reinserted into the lock body, an end camming surface 134 of the shackle short leg 131 (see FIG. 2) engages the latch nose 125, first pivoting the latch 120 about the upper post 115 to align the latch shoulder 127 with the rocker channel 111, and then retracting the latch 120 into the rocker channel 111 to permit full insertion of the shackle 130 into the lock body. When the shackle recess 135 is realigned with the latch nose 125, the latch spring 140 forces the latch 120 back into locking engagement with the shackle recess 135, and into pivoted misalignment of the latch shoulder 127 with the rocker channel 111.

Figure 1A:
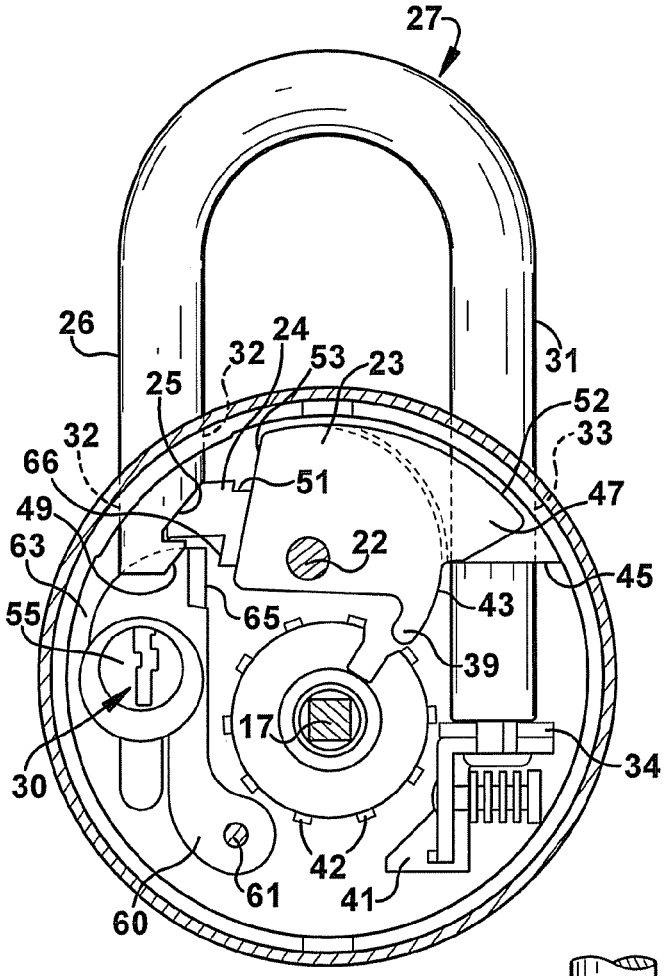
Fig. 1A (Prior Art)
FIG. 1A illustrates a cross-sectional view of a conventional combination padlock in a locked condition.
Figure 1B:
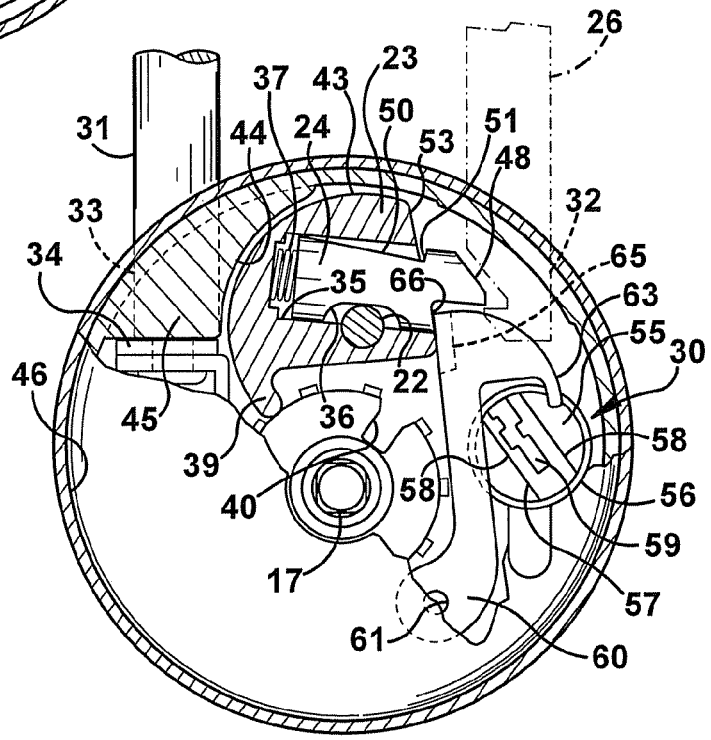
Fig. 1B (Prior Art)
FIG. 1B illustrates a cross-sectional view of the padlock of FIG. 1A in a combination dial operated unlocked condition.
Figure 1C:
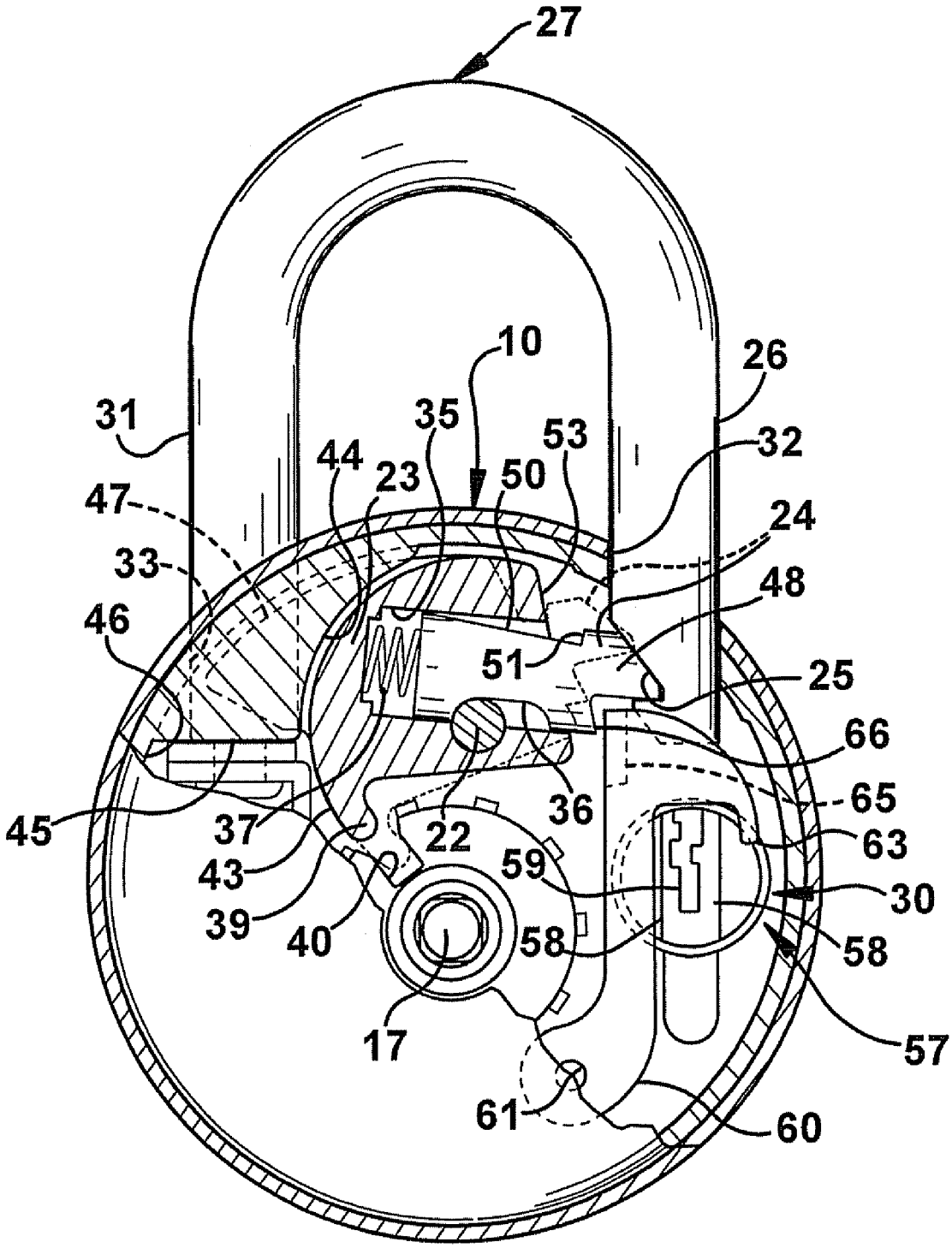
Fig. 1C (Prior Art)
FIG. 1C illustrates a cross-sectional view of the padlock of FIG. 1A in a key operated unlocked condition.

As described in the '275 patent, a combination padlock having a rocker with sliding latch locking member may further include a key operated locking mechanism, which is operable to retract the latch into an unlocked condition for withdrawal of the shackle. As shown in FIGS. 1A-1C, the padlock of the '275 patent includes a key cylinder means 30 that is rotatable (upon insertion of an authorized key) to engage and pivot a release lever 60 for engagement of a release lever projection 65 with a release lever engaging portion or camming face 66 of the latch 24 to retract the latch 24 into the recess 35 of the rocker 23, thereby permitting withdrawal of the short leg 26 of the shackle 27.

Figure 5:
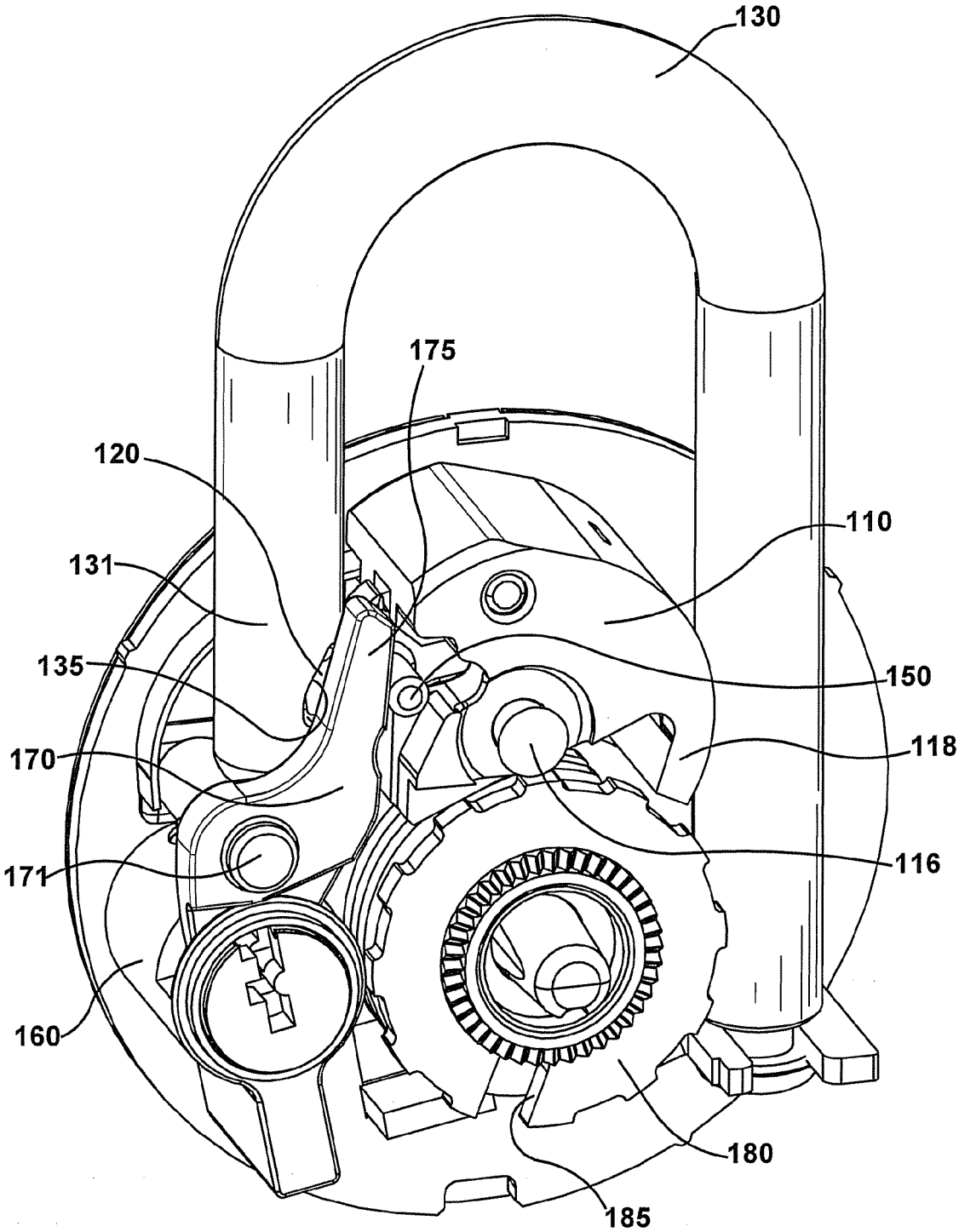
FIG. 5 illustrates another partial perspective view of the lock of FIG. 2.
Figure 6:
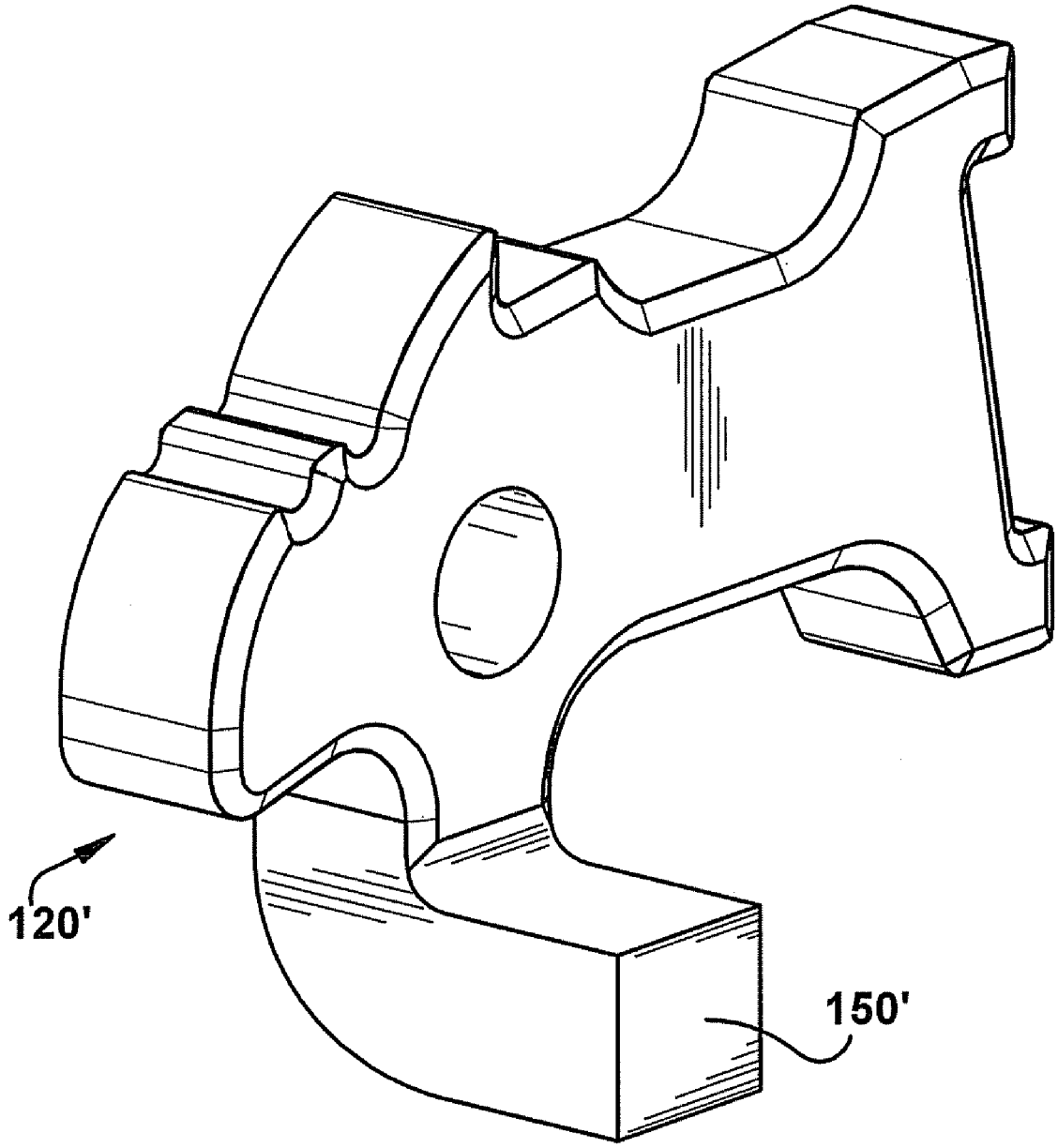
FIG. 6 illustrates a latch for a combination lock.

The inclusion of a key cylinder operated release lever, and release lever engaging portion of the latch, while providing for a key-operating means for unlocking the padlock, may also provide another means for unauthorized manipulation of the latch, as the release lever engaging portion of the latch may potentially be accessed or engaged by a tool inserted between the shackle and the shackle hole. According to an inventive aspect of the present application, a latch may be provided with a release lever engaging portion that is positioned such that a tool inserted between the shackle and the shackle hole may not reach it, for example, by positioning the release lever engaging portion substantially laterally inward of the inner shackle surface 133. While many different locations and structures may be utilized for the release lever engaging portion of the latch, in the illustrated embodiment, the release lever engaging portion is provide as a pin 150 extending outward from a side of the latch 120 laterally inward of the shackle engaging portion 125, such that an inserted shim or other tool may not access the pin 150. As shown in FIG. 5, the release lever 170 may be secured to the key cylinder 160, such that the release lever 170 may not be pivoted by an inserted tool. In another embodiment, as shown in FIG. 6, the release lever engaging portion may be provided as a bent tab or leg 150' extending from the latch 120', also positioned to prevent manipulation by an inserted tool.

When an authorized key is inserted in the key cylinder 160, rotation of the key cylinder 160 pivots the release lever 170 about pivot pin 171 to engage a finger portion 175 of the release lever 170 with the latch pin 150. The angle of engagement between the finger portion 175 and the latch pin 150 is such that the latch 120 is pivoted about the upper post 115 to align the latch shoulder 127 with the rocker channel 111, so that further engagement of the finger portion 175 with the latch pin 150 retracts the latch 120 into the rocker channel 111 to disengage the shackle engaging portion 125 from the shackle recess 135.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A padlock comprising:

a lock body;

a shackle having long and short legs receivable in corresponding first and second shackle openings extending from an upper surface of the lock body and axially moveable between a retracted position and an extended position, the short leg being withdrawn from the lock body when in the extended position;

a locking mechanism disposed in the lock body, the locking mechanism being selectively operable between a locked condition and an unlocked condition; and a latch member disposed in the lock body, the latch member including a laterally outermost shackle engaging portion that lockingly engages a recess in the short shackle leg when the locking mechanism is in the locked condition and is disengageable from the recess when the locking mechanism is in the unlocked condition;

wherein an upper surface of the shackle engaging portion of the latch member includes at least a first notch laterally aligned with a laterally innermost portion of a circumferential edge of the second shackle opening when the shackle engaging portion is in normal locking engagement with the recess; and further wherein the latch member is sized such that upward facing surfaces of the latch member that align with the circumferential edge of the second shackle opening are limited to the first notch when the shackle engaging portion is in a normal locking engagement with the recess.

2. The padlock of claim 1, further comprising a second notch laterally outward of the first notch on the upper surface of the shackle engaging portion of the latch member, wherein the second notch is positioned to align with the laterally innermost portion of the circumferential edge of the second shackle opening when the latch member is rapped to a second position of locking engagement laterally inward of normal locking engagement with the recess.

3. The padlock of claim 1, wherein the locking mechanism comprises a key operated release lever laterally movable to engage a release lever engaging portion of the latch member for lateral movement of the latch member from a shackle engaging position to a disengaged position, the release lever engaging portion being laterally spaced from the circumferential edge of the second shackle opening when the latch member is in the shackle engaging position.

4. The padlock of claim 3, wherein the release lever engaging portion is disposed on a pin extending outward from a side of the latch member.

5. The padlock of claim 3, wherein the release lever engaging portion is disposed on a bent tab extending outward from a side of the latch member.

6. The padlock of claim 1, wherein the locking mechanism comprises a plurality of hubs and a user operable dial configured to rotate each of the plurality of hubs, wherein the locking mechanism is configured to permit the latch member to pivot out of locking engagement with the recess when the plurality of hubs are rotated to a predetermined orientation.

7. The padlock of claim 1, wherein the first notch includes opposed upwardly extending sides.

8. The padlock of claim 1, further comprising a pivotable rocker disposed within the lock body and assembled with the latch member, wherein the pivotable rocker is configured to move the shackle engaging portion of the latch member out of engagement with the recess when the locking mechanism is in the unlocked condition.

9. The padlock of claim 8, wherein the latch member is secured within a channel of the pivotable rocker by upper and lower posts, the latch member being slideable within the channel between extended and retracted positions.

10. The padlock of claim 9, wherein the latch member is pivotable within the channel about the upper post, such that an upward extending shoulder of the shackle engaging portion of the latch member overlaps an upper edge of the channel to impede retraction of the latch member in the channel.

11. A padlock comprising:

a lock body;

a shackle having long and short legs receivable in corresponding first and second shackle openings extending from an upper surface of the lock body and axially moveable between a retracted position and an extended position, the short leg being withdrawn from the lock body when in the extended position;

a locking mechanism disposed in the lock body, the locking mechanism being selectively operable between a locked condition and an unlocked condition; and a latch member disposed in the lock body, the latch member including a laterally outermost shackle engaging portion that lockingly engages a recess in the short shackle leg when the locking mechanism is in the locked condition and is disengageable from the recess when the locking mechanism is in the unlocked condition;

wherein an upper surface of the shackle engaging portion of the latch member includes a first notch laterally aligned with a laterally innermost portion of a circumferential edge of the second shackle opening when the shackle engaging portion is in a normal locking engagement with the recess; and further wherein the upper surface of the shackle engaging portion of the latch member further includes a second notch laterally outward of the first notch.

12. The padlock of claim 11, wherein the second notch is positioned to align with the laterally innermost portion of the circumferential edge of the second shackle opening when the latch member is rapped to a second position of locking engagement laterally inward of normal locking engagement with the recess.

13. The padlock of claim 11, wherein at least one of the first and second notches includes opposed upwardly extending sides.

14. The padlock of claim 11, wherein the locking mechanism comprises a key operated release lever laterally movable to engage a release lever engaging portion of the latch member for lateral movement of the latch member from a shackle engaging position to a disengaged position, the release lever engaging portion extending outward from a side of the latch member.

15. A padlock comprising:

a lock body;

a shackle having long and short legs receivable in corresponding first and second shackle openings extending from an upper surface of the lock body and axially moveable between a retracted position and an extended position, the short leg being withdrawn from the lock body when in the extended position;

a locking mechanism disposed in the lock body, the locking mechanism being selectively operable between a locked condition and an unlocked condition; and a latch member disposed in the lock body, the latch member including a laterally outermost shackle engaging portion that lockingly engages a recess in the short shackle leg when the locking mechanism is in the locked condition and is disengageable from the recess when the locking mechanism is in the unlocked condition;

wherein the locking mechanism comprises a key operated release lever laterally movable to engage a release lever engaging portion of the latch member for sliding lateral movement of the latch member from a shackle engaging position to a disengaged position, the release lever engaging portion being disposed on a projection extending from a frontmost side surface of the latch member, and laterally spaced from a circumferential edge of the second shackle opening when the latch member is in the shackle engaging position.

16. The padlock of claim 15, wherein the projection comprises a pin.

17. The padlock of claim 15, wherein the projection comprises a bent tab.

18. The padlock of claim 15, wherein an upper surface of the shackle engaging portion of the latch member includes at least a first notch laterally aligned with a laterally innermost portion of the circumferential edge of the second shackle opening when the shackle engaging portion is in a normal locking engagement with the recess.

19. The padlock of claim 18, wherein the latch member is sized such that upward facing surfaces of the latch member that align with the circumferential edge of the second shackle opening are limited to the first notch when the shackle engaging portion is in normal locking engagement with the recess.

20. A padlock comprising:

a lock body;

a shackle having long and short legs receivable in corresponding first and second shackle openings extending from an upper surface of the lock body and axially moveable between a retracted position and an extended position, the short leg being withdrawn from the lock body when in the extended position;

a locking mechanism disposed in the lock body, the locking mechanism comprising a plurality of hubs and a user operable dial configured to selectively rotate each of the plurality of hubs to an unlocking orientation; and a latch assembly disposed in the lock body, the latch assembly including a pivotable rocker and a latch member secured within the pivotable rocker by upper and lower posts, wherein when the plurality of hubs are pivoted to the unlocking orientation, the pivotable rocker is permitted to pivot about the lower post to move a laterally outermost shackle engaging portion of the latch member out of locking engagement with a recess in the short shackle leg;

wherein the latch member is slidable from an extended position to a retracted position within a channel in the pivotable rocker to disengage the shackle engaging portion of the latch member from the recess, the latch member being spring biased toward the extended position by a spring disposed between spring bearing surfaces of the latch member and pivotable rocker;

further wherein an upper surface of the latch member is pivotable within the channel about the upper post such that an upward extending shoulder of the shackle engaging portion of the latch member overlaps an upper edge of the channel to impede retraction of the latch member into the channel; and further wherein when the upward extending shoulder of the shackle engaging portion of the latch member overlaps the upper edge of the channel to impede retraction of the latch member into the channel, the spring bearing surface of the latch member is angled laterally inward, from an upper portion of the latch member to a lower portion of the latch member, with respect to the spring bearing surface of the pivotable rocker.

* * * * *